US005771734A

United States Patent [19]

Robbins

[11] Patent Number: 5,771,734

[45] Date of Patent: Jun. 30, 1998

[54] REPLACEABLE RING FOR DUMMY BLOCK

[76] Inventor: Paul H. Robbins, 5 Springmaple Chase, Aurora, Ontario L4G 6X1, Canada

[21] Appl. No.: 683,268

[22] Filed: Jul. 18, 1996

[51] Int. Cl.[6] ..... B21C 25/00

[52] U.S. Cl. ..... 72/273

[58] Field of Search ..... 72/273, 273.5, 72/272, 253.1, 264, 265, 478

[56] References Cited

U.S. PATENT DOCUMENTS

| | | | |
|---|---|---|---|
| 3,282,074 | 11/1966 | Gardner | 72/273 |
| 3,303,684 | 2/1967 | Starr et al. | 72/273 |
| 3,630,064 | 12/1971 | Mahns | 72/273.5 |
| 3,831,418 | 8/1974 | Bogdanov et al. . | |
| 3,919,873 | 11/1975 | Biswas et al. | 72/273 |
| 3,977,226 | 8/1976 | Mann et al. . | |
| 4,024,743 | 5/1977 | Decours et al. . | |
| 4,550,584 | 11/1985 | Degen | 72/273 |
| 4,714,423 | 12/1987 | Hattori et al. | 72/273 |
| 5,272,900 | 12/1993 | Robbins . | |
| 5,311,761 | 5/1994 | Robbins . | |

FOREIGN PATENT DOCUMENTS

| | | | |
|---|---|---|---|
| 4132810 | 8/1988 | Germany . | |
| 0137514 | 6/1988 | Japan | 72/273.5 |
| 569354 | 8/1977 | U.S.S.R. . | |
| 593766 | 2/1978 | U.S.S.R. | 72/273 |
| 0668738 | 7/1979 | U.S.S.R. | 72/273 |
| 0852400 | 8/1981 | U.S.S.R. | 72/273 |
| 0897361 | 1/1982 | U.S.S.R. | 72/273.5 |
| 0946714 | 7/1982 | U.S.S.R. | 72/273 |

*Primary Examiner*—Lowell A. Larson
*Assistant Examiner*—Ed Tolan
*Attorney, Agent, or Firm*—Young & Basile P.C.

[57] ABSTRACT

In a dummy block construction for use in extruding an extrudable metal, the dummy block having a dummy block base; a connector for connecting said dummy block base to a stem of an extruder; a replaceable wear ring connected to a forward circumferential portion of said dummy block base; a device for releasably securing said wear ring to said dummy block base; a device for expanding said ring to engage a billet container inside wall of an extrusion press during extrusion of a billet of extrudable metal through such extrusion press, the improvement being characterized in the wear ring being a metal collar having a conical interior surface converging towards said dummy block base; and the device for expanding the ring comprising a metal plunger having a plunger head with a conical surface for engaging the collar conical surface to expand the collar as said plunger head is forced into the collar during extrusion; the plunger head having a planar face and the collar having a forward planar face; the converging surfaces of the collar and the plunger head extending a sufficient distance to permit telescoping of the plunger head into the collar to an extent whereby the plunger head face is essentially planar with the face of said collar.

10 Claims, 7 Drawing Sheets

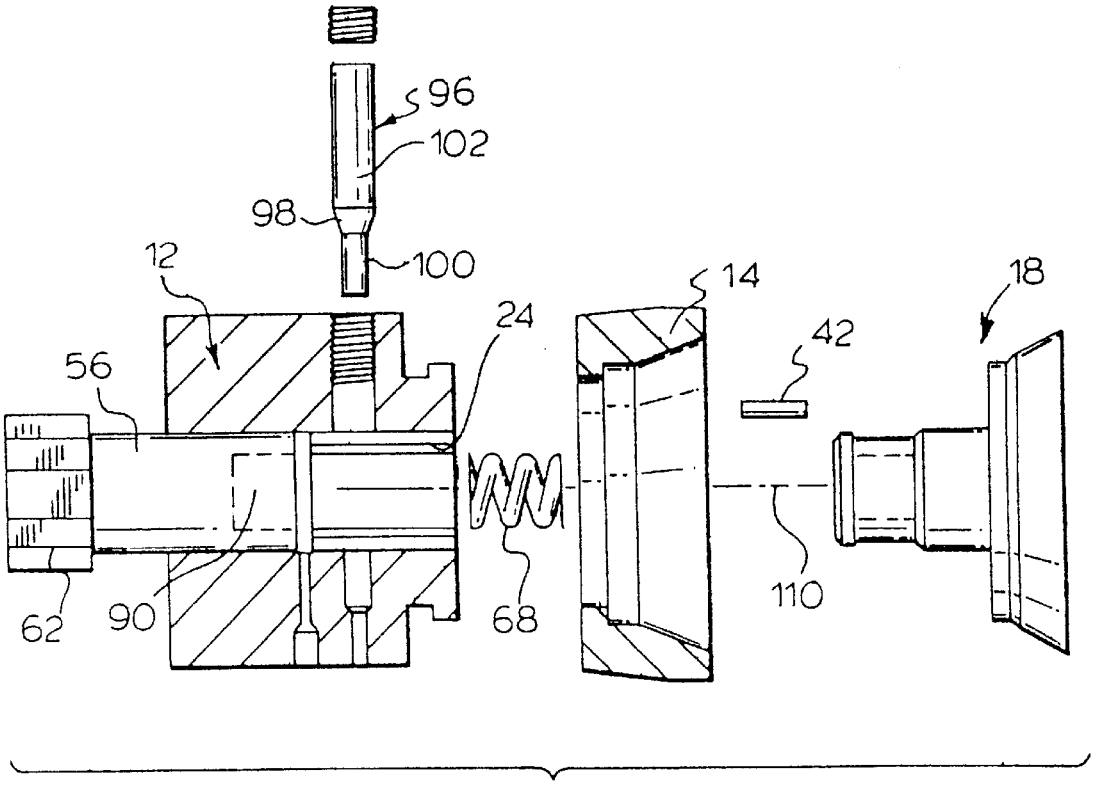
FIG. 3.
FIG. 4.
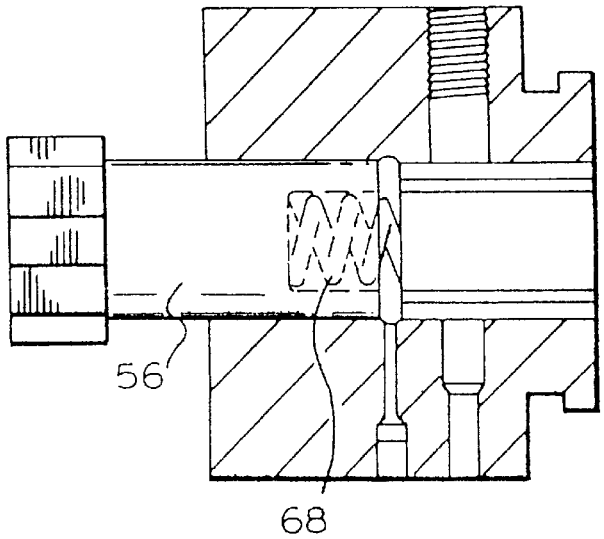

REPLACEABLE RING FOR DUMMY BLOCK

FIELD OF THE INVENTION

This invention relates to a dummy block construction having an improved replaceable wear ring system.

BACKGROUND OF THE INVENTION

The dummy block construction as described in applicant's U.S. Pat. Nos. 5,272,900 and 5,311,761 provide a venting device for the dummy block and a bayonet type connector for connecting the dummy block to a stem of a extrusion press. The venting device which is more commonly referred to as a plunger is pushed inwardly of the dummy block when the dummy block abuts a billet of extrudable metal in a container of an extrusion press. When the venting device is closed it slightly expands the dummy block circumference to contact the interior surface of the container to preclude thereby metal flashing beyond and behind the dummy block face. With correct machining of the dummy periphery and positioning of the plunger, the dummy block periphery can be expanded to the extent desired to minimize metal flashing. However, over extended periods of use, the circumferential portion of the dummy block looses its strength and hence fails to seal the face of the dummy block to the container interior, hence metal flashing becomes a problem. Also, as the circumferential portion of the dummy block loses its strength, the plunger may wedge and become jammed within the dummy block, so that it does not release when the dummy block is retracted from the container of the extrusion press. It is then necessary to return the dummy block for refurbishing and retooling whereby the refurbished dummy block has a circumferential forward portion which exhibits the desired strength characteristics to minimize flashing and minimize jamming of the plunger within the dummy block.

Although the above type of dummy block construction is particularly suited to the extrusion of various extrudable metals which include aluminum alloy, copper, bronze, brass and the like, various attempts have been to solve the problem associated with the above type of dummy block. Various types of wear rings have been provided on the dummy block, for example, U.S. Pat. No. 4,024,743 describes a compressible, expandable seal for use in a piston extrusion of hot or cold metal billet. The seal is designed to flow outwardly of the plunger and contact the container to prevent flashing of metal beyond and behind the plunger. This system normally hangs up on the butt portion of the billet in the container, so that when the plunger is withdrawn, the seal is destroyed which requires replacement.

U.S. Pat. No. 3,977,226 describes a floating ring seal for extruding metals. The floating ring seal has the same problem as the seal in U.S. Pat. No. 4,024,743. When the ram is withdrawn from the container, the seal will hang up on the butt of the billet of extruded metal, requiring clean out of the extrusion container.

U.S. Pat. No. 3,831,418 describes a die assembly for extruding aluminum and its alloys. The die assembly includes a ring at the face of the die assembly and which is expanded outwardly by inwardly sloping surfaces converging towards the front of the die assembly. This requires that the ring move rearwardly of the edge assembly in order to expand and engage container wall thereby exposing a portion of the front of the die assembly. Due to this movement of the ring in the reverse direction along the die assembly, gaps may be created through which metal may flash beyond and behind the die assembly. This causes significant problems with respect to removal of the die assembly from the extrusion container. With either the interlocking engaging teeth or bayonet style connection of the ring to the die assembly, the ring in moving rearwardly does not expand readily because of the low surface area of the ring which has exposed the metal billet and hence further metal flashing may be a problem around the perimeter of the die assembly.

Russian Patent 569,354 describes a dummy block system for metal extruders which has a conical ring with a conical outside surface for expanding the ring as the dummy block contacts the billet of material in the extruder container. The ring is thin and is caused to expand by sliding rearwardly on a sloping face of the dummy block. A forward portion of the dummy block is slidably mounted to move rearwardly and push the ring up the sloped surface. The face of the dummy block has a indentation where the metal portion which moves the ring rearwardly has to advance onto the dummy block structure. This as well can cause significant metal flashing problems where the pressures within the container can exceed upwardly of 100,000 psi. Any clearance at all will result immediately in metal flashing and thereby block the extraction of the dummy block from the extruder container. Furthermore, with the relative slope of the ring to the dummy block surfaces, there is a greater likelihood of jamming because the angle of the sloping surfaces is considerably less than 20° from the longitudinal axis of the dummy block. This can also result in the ring jamming and staying expanded and thereby further hindering the extraction or withdrawal of the dummy block from the extruder container.

German Patent Application 4,132,810 describes a dummy block construction for a metal extruder where the seal arrangement is like that described in U.S. Pat. No. 4,024,743. The dummy block has a central concave shaped piston which is moved rearwardly into the dummy block to expand the seal and engage thereby the container interior surface. The seal has a tendency to hang up on the interior of the container at the completion of an extrusion. Furthermore, the piston can yield which would inherently reduce the extent of expansion of the seal and thereby result in a significant problem regarding metal flashing passing beyond and behind the dummy block.

Accordingly, this invention overcomes a number of the above problems by providing an improved wear ring on the dummy block which is substantial in form and constitutes a replaceable collar about the forward portion of the dummy block. An improved design with respect to a plunger which enters the dummy block during the extrusion process ensures a consistent reproducible expansion of the collar to seal the container interior and thereby minimize metal flashing beyond and behind the dummy block and as well minimize jamming of the plunger within the dummy block by virtue of the expanded collar.

SUMMARY OF THE INVENTION

In accordance with an aspect of the present invention, there is provided a dummy block construction for use in extruding an extrudable metal, the dummy block having:

i) a dummy block base;

ii) means for connecting the dummy block base to a stem of an extruder;

iii) a replaceable wear ring connected to a forward circumferential portion of the dummy block base;

iv) means for releasably securing the wear ring to the dummy block base;

v) means for expanding the ring to engage a billet container inside wall of an extrusion press during extrusion of a billet of extrudable metal through such extrusion press, the improvement being characterized in:

vi) the wear ring being a metal collar having a conical interior surface converging towards the dummy block base;

vii) the means for expanding said ring comprising a metal plunger having a plunger head with a conical surface for engaging the collar conical surface to expand said collar as the plunger head is forced into the collar during extrusion;

viii) the plunger head having a planar face and the collar having a forward planar face;

ix) the converging surfaces of the collar and the plunger head extending a sufficient distance to permit telescoping of the plunger head into the collar to an extent whereby the plunger head face is essentially planar with the face of the collar.

BRIEF DESCRIPTION OF THE DRAWINGS

Various embodiments of the invention as described with respect to the drawings wherein:

FIG. 3 is a side elevation of the exploded view of FIG. 1;

FIGS. 4 through 8 are various side elevations showing the assembly of the dummy block construction of FIG. 3;

DETAILED DESCRIPTION OF THE PREFERRED EMBODIMENTS

Figure 1:
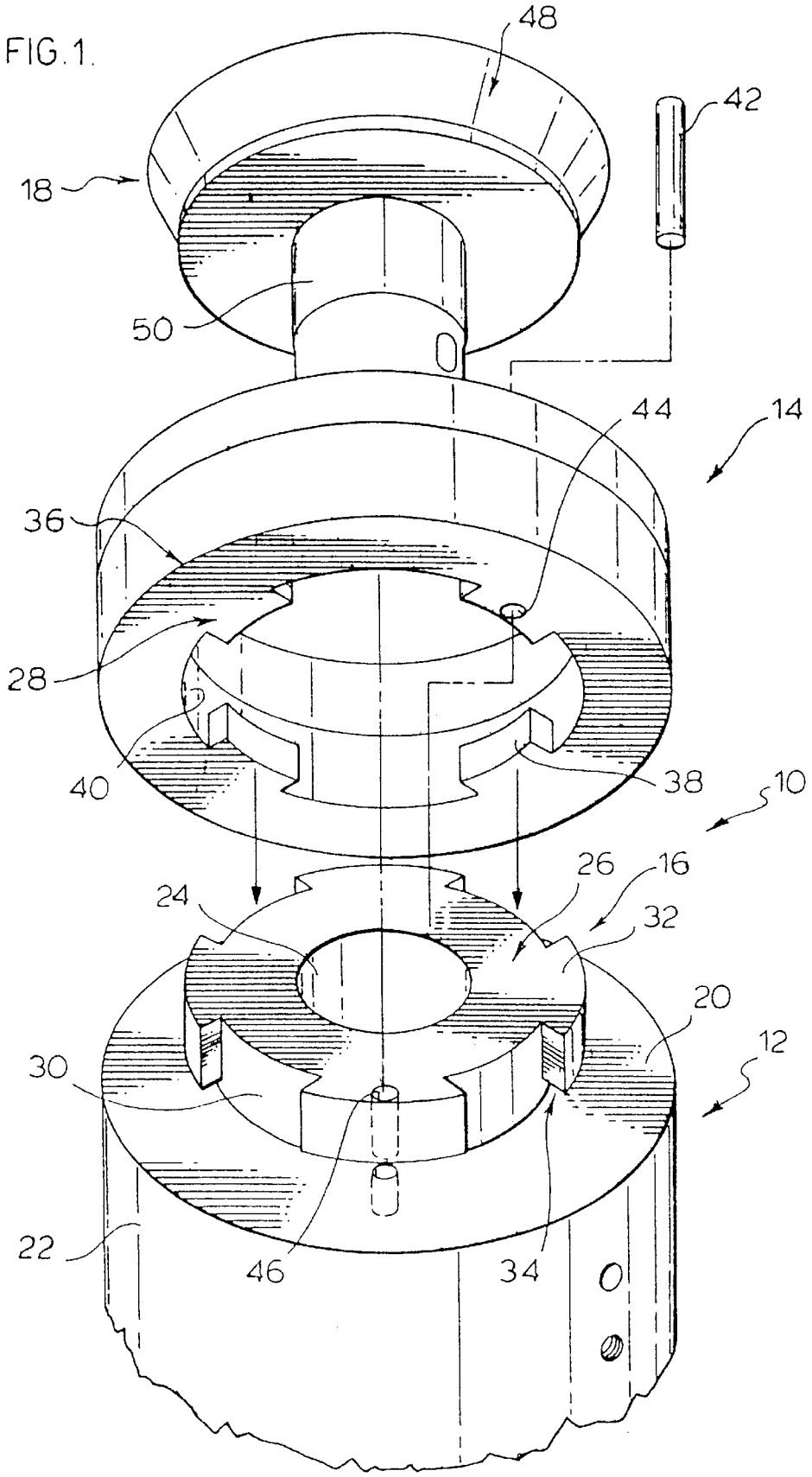
FIG. 1 is an exploded view of a removable collar for a dummy block base.

The removable collar for the dummy block construction of FIG. 1 provides many significant advantages as will become apparent in the discussion of the various embodiments of the invention. In FIG. 1, the dummy block construction 10 has a dummy block base 12, a replaceable collar 14 which is connected to the dummy block base by the bayonet type connector 16 and a plunger 18 which moves within the collar 14 to expand it when the face of the dummy block contacts a billet of metal in the extruder container. In accordance with this preferred embodiment, the dummy block base has a planar face portion 20 with a cylindrical body portion 22 into which a bore 24 extends. The bayonet connector 16 has a first component 26 and a second component 28 on the collar 14. The first component 26 is machined from the interior of the body portion 22 to provide an upstanding stud 30 with individual equidistant spaced apart lugs 32. The lugs 32 are spaced slightly above face 20 as indicated for example by the space in area 34.

The collar 14 has in its base portion generally indicated at 36, the second component 28 of the bayonet connector. The second component comprises a plurality of inwardly extending lugs 38 which project inwardly from interior cylindrical surface 40. The lugs 38 pass between the respective lugs 32 of the first component 26 and fit within the spaces 34 with the collar 14 rotated to position the lugs 38 beneath the lugs 32. A connection of the collar to the dummy block base 12 thereby is provided.

Although the lugs 32 and 38 are shown as approximately equal thickness, it is understood that the sets of lugs 32 and 38 may be of different thickness. To ensure the collar does not rotate and slide off of the dummy block base, a locating and securing pin 42 is passed through a bore 44 in the lug 38 and through the bore 46 of the lug 32 and wedged in place to ensure that the collar remains connected to the dummy block base 12. The pin 42 may be subsequently removed to permit removal and replacement of the collar 14 as required for the reasons to be discussed in respect of the other Figures.

The plunger 18 has a plunger head portion 48 with a depending plunger post 50. With the collar assembled to the dummy block base the plunger post 50 is inserted through bore 24 and connection completed as will be described with respect to FIGS. 2, 7 and 8.

Figure 2:
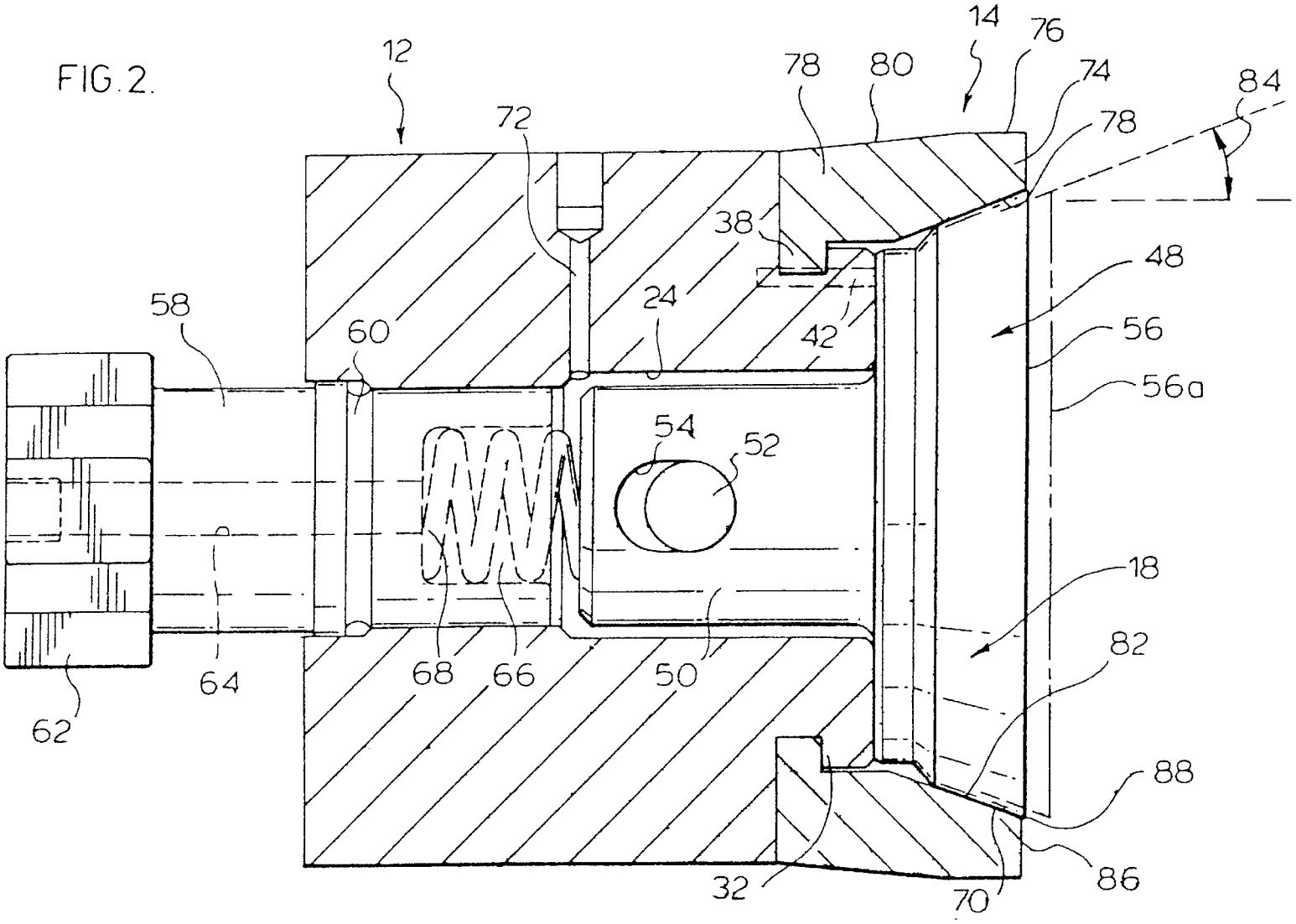
FIG. 2 is a section through the assembled dummy block construction.

FIG. 2 shows a section through the assembled dummy block construction of FIG. 1. The plunger 18 has its post 50 inserted in the bore 24 of the dummy block base 12. A pin 52 extends through an elongate aperture 54 to locate the plunger 18 in the dummy block construction and allow for inward and outward movement of the plunger face 56 between its operating position as shown and its outwardly extended position as shown in dot at 56*a*. Also provided within bore 24 in accordance with this particular embodiment is the stud portion 58 which is secured in the dummy block base 12 by a suitable pin inserted in the circumferential groove 60. The stud 58 has a bayonet connector arrangement 62 of the type described in applicant's U.S. Pat. No. 5,272,900 for connecting the dummy block to the stem of the extruder. It is appreciated that other types of connecting devices may be used in connecting the dummy block base 12 to the stem of an extruder. For example, a stud arrangement may be provided as described and shown in applicant's U.S. Pat. No. 5,311,761. Alternative constructions maybe, for example, the use of a connecting rod which extends through and outwardly of the stem into which the dummy block is threaded. It is also understood that other types of connecting devices as are commonly use in connecting the dummy block base to the stem may be employed in conjunction with the features of the replaceable collar of this invention.

This system may also include the necessary venting arrangement to allow air to escape from between the face of the dummy block and the billet in the container as the dummy block is advanced in the extruder. This feature of venting is described in respect of applicant's U.S. Pat. No. 5,311,761. It is also understood that the dummy block may be cooled by directing air in the opposite direction through an internal bore 64 in the stud 58. The air then flows into the region 66 which houses the spring 68 and can flow over the post 50 and out through the gap 70 defined between the interior surface of the collar 14 and the plunger when the face is in position 56*a*. When the plunger is in the closed position, the air that flows in through bore 64 flows outwardly through a transverse passage 72 of the dummy block. Such flow of air either when the plunger is in the open position or in the closed position provides additional cooling for the dummy block and as well cools the face of the billet when the plunger is in the open non billet contacting position.

The collar 14 is of substantial section and is considerably larger than the prior art wear rings. The collar 14 has a forward portion 74 with an outer surface 76 and an inner surface 78. The collar 14 also has a rearward portion 78 having rearwardly converging surface 80. Portion 78 carries the lugs 38 of the bayonet connector which fit behind lugs 32 of the bayonet connector. The positioning of the pin 42 is shown to hold the collar 14 in place.

The collar interior surface 78 converges rearwardly of the dummy block construction. The plunger head 56 includes a rearwardly converging surface 82 which has a slope as indicated by arrow 84 in the range of 20° to 25°. The slope of the interior surface of the collar is slightly less than the slope of the plunger head to ensure that the two do not become jammed when the plunger assembly is in use. If the slope of the face 82 of the plunger head were the same as the slope of the face 78 of the collar, the faces would jam as the plunger head telescopes within the collar so that when the dummy block is removed from the container, the spring 68 does not have sufficient spring force to pop the plunger out to position 56*a*.

For the reasons described in applicant's U.S. Pat. No. 5,311,761, the spring 66 is provided to pop the plunger 56 outwardly of the collar 14 to ensure that the dummy block breaks away from the butt of the extruded billet of metal. Also the movement of the plunger in and out of the collar 14 effects the necessary outward expansion of the collar 14 during the extruding process to ensure that metal does not flash beyond and behind the dummy block. As the plunger head 48 telescopes within the collar 14, it causes the ring in the area of body portion 74 to expand circumferentially and cause the surface 76 to come into contact with the interior of the extruder container. This ensures that metal does not flash beyond the face 86 of the collar. Also it is important to note that with the dimensioning of the collar and movement of the plunger, the face 56 of the plunger is essentially planar with the face 86 of the collar. It is understood of course that depending upon the sizing of the collar and the plunger, it may be that the plunger face 56 is slightly inwardly or outwardly of the collar face 86. Again, the fitting is such to ensure that at the joint 88 of the plunger face with the collar that the space at the joint is essentially imperceptible to prohibit flashing of metal into the joint 88 between the plunger head 48 and the interior of collar 14.

Figure 5:
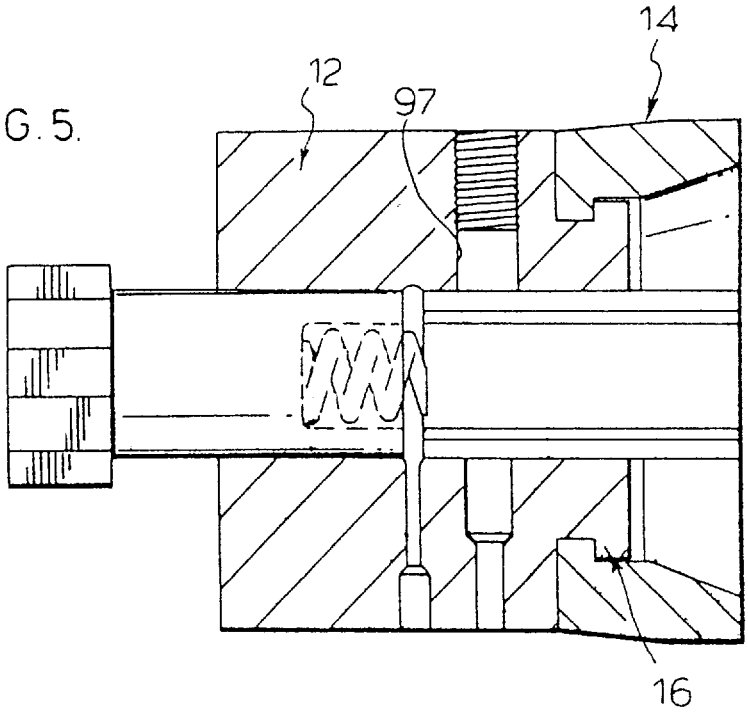
Figure 6:
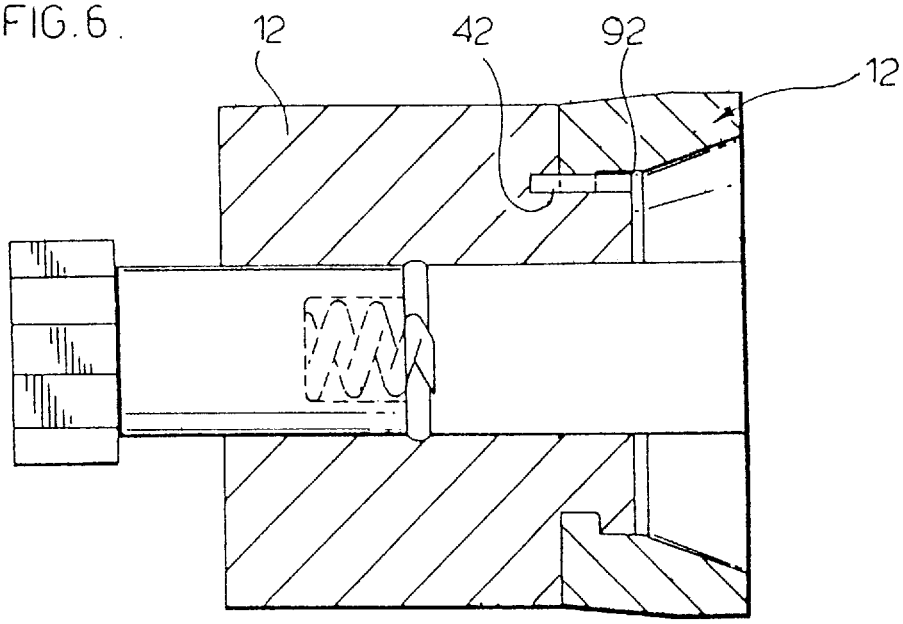
Figure 7:
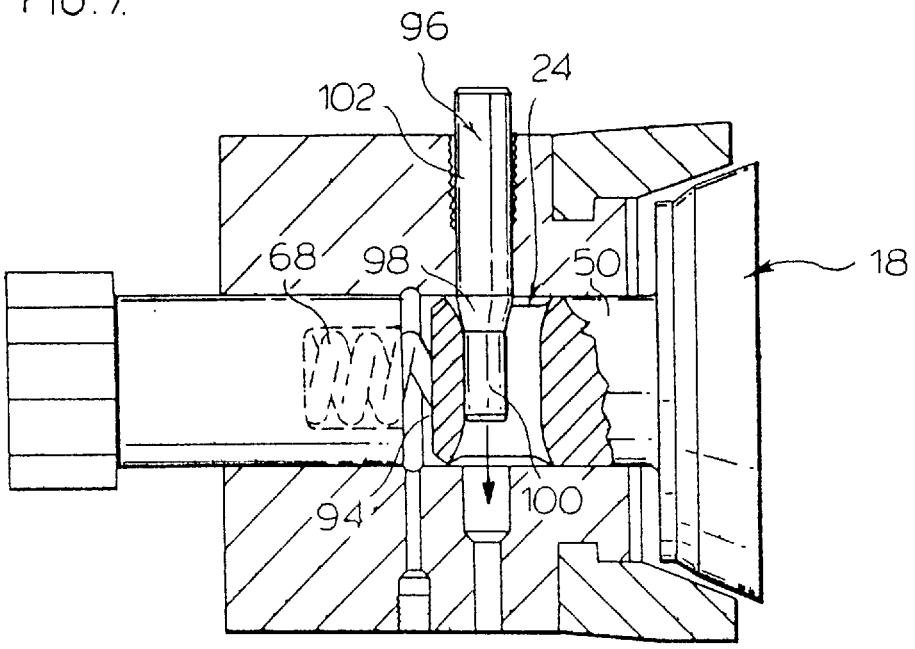

With reference to FIG. 3, the manner in which the components are assembled shall be described. The dummy block base 12 as the stud 56 with bayonet connector 62 mounted therein and held in place by suitable screw connection or the like. The bore 24 of the dummy block base is open and ready to receive the spring 68 to be located in space 90 of the stud 56. The collar 14 and plunger 18 are set aside until the spring is positioned within the stud 56 in the manner shown in FIG. 4. The next step in the assembly is to connect the collar 14 to the dummy block base 12 by way of the bayonet interconnection at 16. The next step in the connection is to locate pin 42 in place and wedge it in region 92 to locate the pin and thereby fix the location of the collar 14 relative to the dummy block base 12. As shown in FIG. 7, the next step is to insert the plunger 18 with its post 50 in the bore 24 such that its end portion 94 abuts the spring 68. A tapered pin 96 is advanced through the passageway 97 as shown in FIG. 5 where the pin 96 has a tapered portion 98 which interconnects the narrower first diameter portion 100 to the larger second diameter portion 102 of the pin 96.

Figure 8:
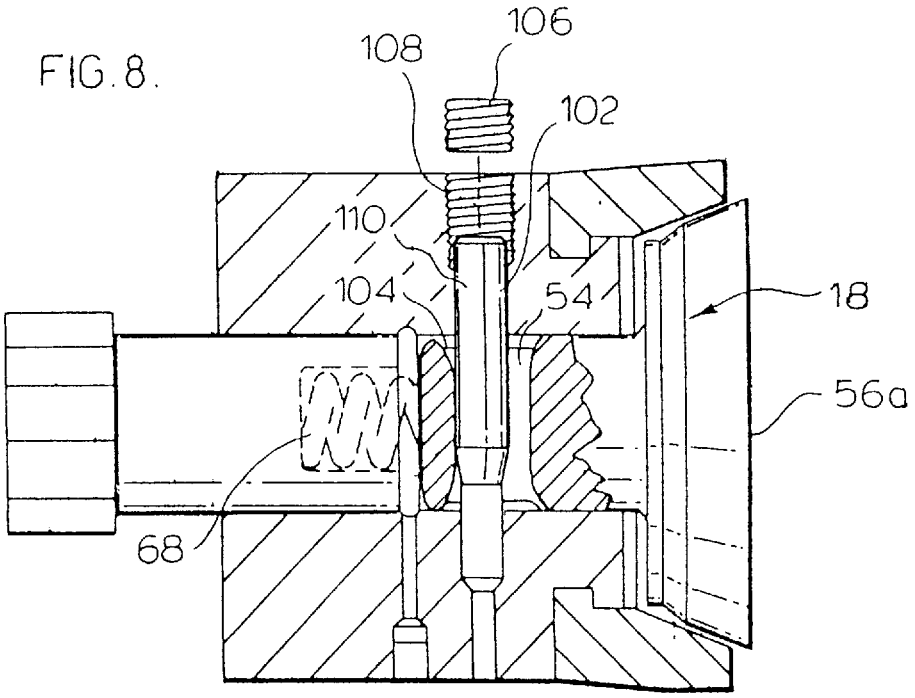

As the pin is advanced into the passage way 97, the tapered land portion 98 abuts the chamfered surface 104 of the elongate opening 54 to move the plunger post 50 rearwardly such that the plunger face is in the position 56*a* of FIG. 8. By moving the post 54 rearwardly, the spring 68 is slightly compressed to ensure that there is tension at all times in the spring 68. Such slight compression of the spring 68 also ensures that when the dummy block is extracted from the container, the plunger 18 will pop out to facilitate separation of the dummy block from the butt of the billet. In accordance with this particular embodiment, the enlarge second diameter portion of the pin 96 locates the rearward portion 94 of the post in the correct position to compress the spring slightly. To maintain the position of the post or tapered pin 96 a threaded Allen screw 106 is threaded into the threaded bore 108 and contacts the top portion 110 of the tapered pin to hold in place and hence maintain the plunger in place within the dummy block.

The replaceable collar of this dummy block construction provides many significant advantages while retaining all of the features and advantages of the dummy block construction of applicant's earlier U.S. Pat. No. 5,311,761 and as well the bayonet connection of their earlier U.S. Pat. No. 5,272,900. The collar 14 may be made of standard tool steel and optionally coated with wear resistant material to enhance the durability of the collar. It is also understood that the collar may be formed of steel which has a greater yield strength to accommodate the cyclical action of expansion and contraction due to the inward and outward telescopic movement of the plunger. By correctly defining the sloping portions of the plunger and the collar jamming of the two together during the cyclical operation of the dummy block is avoided. Preferably the angle is in the range of 20° to 25° relative to the longitudinally axis 110 of the dummy block construction. By provision of the strengthened collar 14 which is readily connected to and removed from the dummy block base, it is no longer necessary to return the dummy block base to the manufacturer for refurbishing. Instead, the dummy block base may simply have a worn collar removed therefrom and a new collar inserted thereon for resumption of extrusion. The collar may be readily located on the dummy block base by the use of a pin although it is understood that various other types of interconnecting devices may be used to ensure that the bayonet type connection of the collar to the dummy block base keeps the collar in place and does not allow it to float relative to the movement of the plunger head. If the collar were allowed to float relative to the plunger head, there is greater chance that the collar could become jammed on the plunger head such that when the dummy block is retracted, the plunger head will not pop out of the dummy block base, hence jamming the dummy block in the container of the extruder. The system is also readily adapted for extruding higher temperature metals by use of a replaceable collar. The extruder may be used for the higher temperature metals by simply using a higher strength collar such as that made of Niconal (trademark). This permits ready change over of the less expensive dummy block base to the more expensive types of dummy blocks for extruding harder metal by simply replacing the collar.

Figure 9:
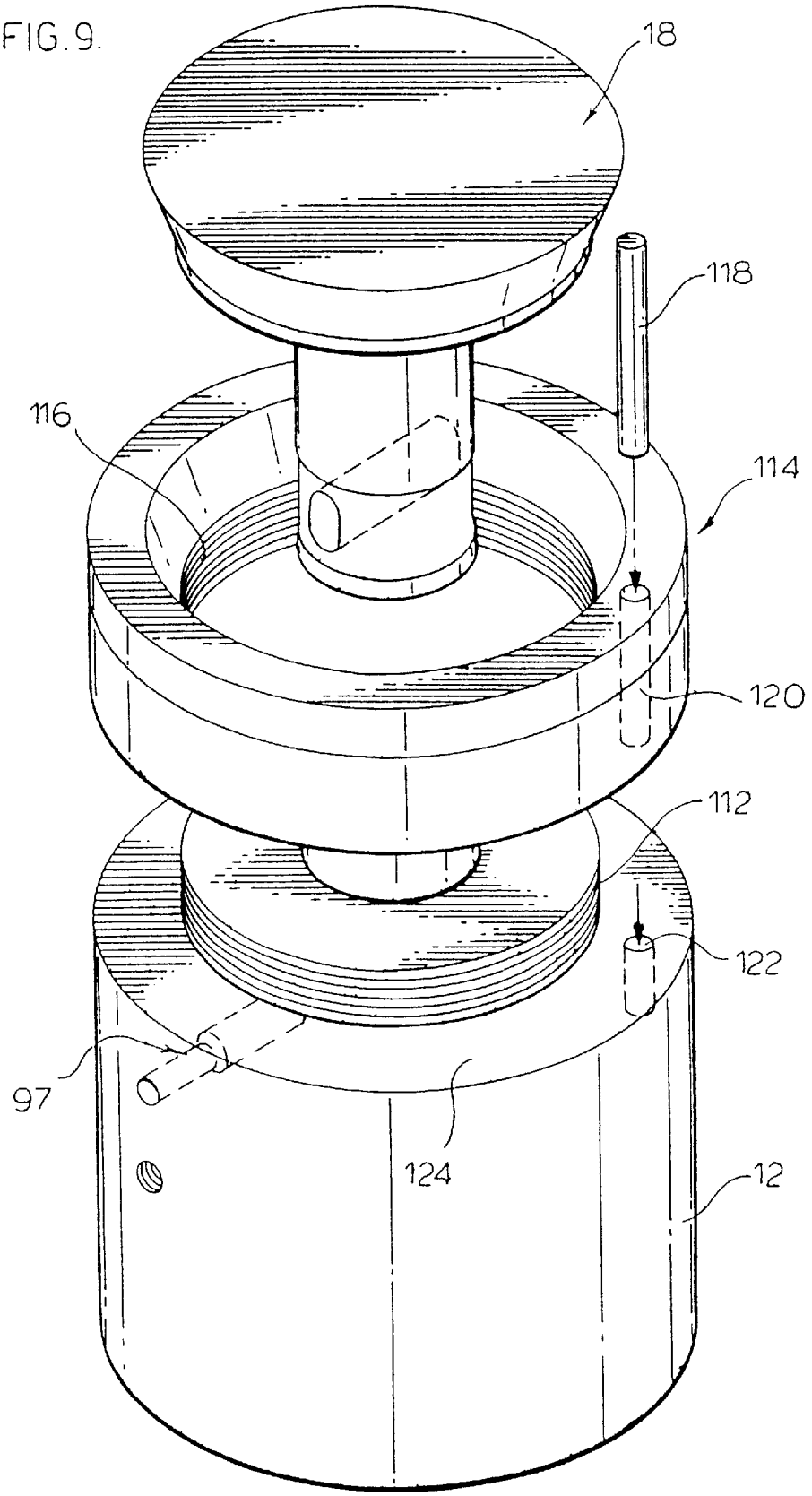
FIG. 9 shows an alternative embodiment for the collar connection to the dummy block base.
Figure 10:
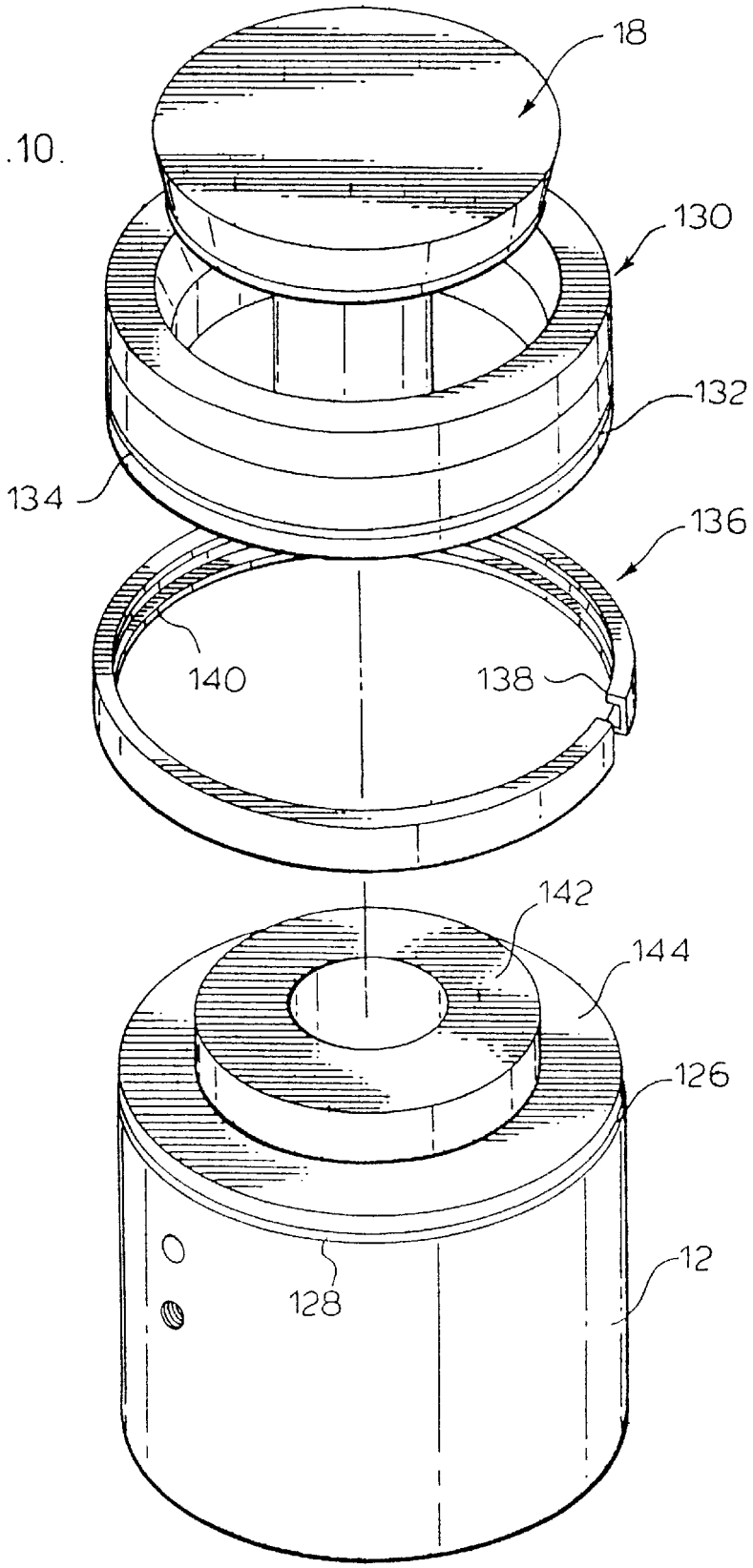
FIG. 10 shows an alternative embodiment for the connection of the collar to the dummy block base.

Various alternative embodiments for the collar mounting on the dummy block base are described with respect to FIGS. 9 and 10. As shown in FIG. 9, the dummy block base 12 is modified to include a threaded stub 112. The collar 114 has an internal threaded portion 116 which is threaded on the stub 112. The pin 118 as it passes through the bore 120 and into the dummy block base through the continuation of the bore 122 locates the threaded collar 114 on the dummy block base 12. The plunger 18 functions in the same manner and is secured within the dummy block base by a pin extending into the threaded aperture portion 97. Of course, the pin apertures 120 and 122 are normally formed in the dummy block after the collar 114 is threaded thereon to ensure that the collar 114 is snug against the face 124 of the dummy block base to ensure that excessive pressure is not exerted on the threads 112 and 116 of the dummy block base stub and the collar threaded portion 116.

A further alternative arrangement is shown in FIG. 10 where the dummy block base 12 has its outer periphery at 126 formed with a groove 128. Correspondingly, the collar 130 has a groove 132 formed in its outer peripheral portion 134. A connecting ring 136 having depending legs 138 and 140 are respectively fitted in grooves 132 and 128, when the collar is assembled about the stub 142 of the dummy block base 12. The ring 136 is wedged in place to keep the collar in position against the face 144 of the dummy block base and thereby ensure that the collar 130 is always in the correct operating position relative to the plunger 18.

Although preferred embodiments of the invention are described herein in detail, it will be understood by those skilled in the art that variations may be made thereto without departing from the spirit of the invention or the scope of the appended claims.

I claim:

1. In a dummy block construction for use in extruding an extrudable metal, said dummy block having i) a dummy block base;

ii) means for connecting said dummy block base to a stem of an extruder;

iii) a replaceable wear ring connected to a forward circumferential portion of said dummy block base;

iv) means for releasably securing said wear ring to said dummy block base;

v) means for expanding said ring to engage a billet container inside wall of an extrusion press during extrusion of a billet of extrudable metal through such extrusion press;

the improvement being characterized in:

vi) said wear ring being a metal collar having a conical interior surface converging towards said dummy block base; and vii) said means for expanding said ring comprising a metal plunger having a plunger head with a conical surface for engaging said collar conical surface to expand said collar as said plunger head is forced into said collar during extrusion;

viii) said plunger head having a planar face and said collar having a forward planar face;

ix) said converging surfaces of said collar and said plunger head extending a sufficient distance to permit telescoping of said plunger head into said collar to an extent whereby said plunger head face is essentially planar with said face of said collar.

2. In a dummy block construction of claim 1, said plunger having a post extending into said dummy block base, means provided in said dummy block base for mechanically biasing said plunger head outwardly of said collar, said mechanical biasing means having sufficient biasing force to pop said plunger head outwardly of said collar when said dummy block is withdrawn from an extrusion press container to allow said collar to collapse.

3. In a dummy block construction of claim 2, said means for releasably securing said collar to said dummy block base is a bayonet-type connection, a threaded connection or a clip-type connection.

4. In a dummy block construction of claim 1, said means for releasably securing said dummy block base is a bayonet-type connection, said bayonet-type connection is pinned in the collar securing position.

5. In a dummy block construction of claim 4, said dummy block base has a cylindrical body portion with an axially extending bore, said connecting means for connecting said dummy block to said stem being secured in said bore in a rearward portion of said body portion, said plunger having a post extending into said dummy block base through a forward portion of said bore, a spring mounted in said bore and bearing against a distal end of said plunger post to bias said plunger head face outwardly of said collar and means for releasably retaining said post in said bore.

6. In a dummy block construction of claim 5, said retaining means for said plunger post locates said shaft in said bore to tension slightly said spring.

7. In a dummy block construction of claim 6, said retaining means comprises an elongate slot extending transversely through said shaft and a tapered stud slid through a transversely extending channel in said dummy block base, said tapered stud engaging said elongate slot to move said shaft in tensioning slightly said spring and a set screw in said channel to position said stud.

8. In a dummy block construction of claim 7, said elongate slot having a chamfered entrance to receive said tapered stud.

9. In a dummy block construction of claim 8, said tapered stud having a narrower first diameter portion and larger second diameter portion interconnected by a tapered land portion, said second diameter portion determining plunger post position for slightly tensioning said spring.

10. In dummy block construction of claim 9, said mating converging surfaces of said collar and said plunger having a slope in the range of 20° to 25° relative to a longitudinal axis of said plunger shaft where the slope of the converging surface of said plunger is slightly greater than the slope of the converging surface of the collar.

* * * * *